US005626544A

United States Patent [19]

Foresto

[11] Patent Number: 5,626,544

[45] Date of Patent: May 6, 1997

[54] EXERCISE DEVICE FOR AMPUTEES

[76] Inventor: Michael A. Foresto, 503 Pulaski Rd., Greenlawn, N.Y. 11740

[21] Appl. No.: 343,771

[22] Filed: Nov. 22, 1994

[51] Int. Cl.[6] ..... A63B 21/00

[52] U.S. Cl. ..... 482/124; 482/10; 482/93

[58] Field of Search ..... 482/10, 105, 121, 482/129, 124, 139, 93, 92

[56] References Cited

U.S. PATENT DOCUMENTS

| | | | |
|---|---|---|---|
| 1,517,147 | 11/1924 | Burnett | 482/10 |
| 1,543,346 | 6/1925 | Titus | 482/10 |
| 3,751,031 | 8/1973 | Yamauchi . | |
| 4,109,907 | 8/1978 | Zito . | |
| 4,372,553 | 2/1983 | Hatfield . | |
| 4,685,671 | 8/1987 | Hagerman et al. . | |
| 4,779,867 | 10/1988 | Hinds . | |
| 5,048,825 | 9/1991 | Kelly . | |
| 5,167,601 | 12/1992 | Frappier | 482/129 |
| 5,207,626 | 5/1993 | Einhorn et al. . | |
| 5,242,347 | 9/1993 | Keeton | 482/10 |
| 5,431,617 | 7/1995 | Rattray | 482/121 |

OTHER PUBLICATIONS

Bob Radocy, Upper–Extremity Prosthetics: Considerations and Designs for Sports and Recreation, Clinical Prosthetics and Orthotics, vol. 11, No. 3, pp. 131–153, 1987.

*Primary Examiner*—Stephen R. Crow
*Attorney, Agent, or Firm*—Dilworth & Barrese

[57] ABSTRACT

A resistance exercise device is disclosed for an amputee which includes a harness assembly configured to engage the stump portion of an amputated limb. The harness assembly includes a circumferential support strap and a depending retention portion. A mechanism is provided for affording dynamic resistance to the amputee during the performance of an exercise, and fastening members are associated with said circumferential support strap for engaging the resistance mechanism.

20 Claims, 3 Drawing Sheets

10
16
20
34a
34b
B
54
12
26
40
52
46
48
50
36
44
36

EXERCISE DEVICE FOR AMPUTEES

BACKGROUND OF THE INVENTION

1. Field of the Invention

This invention relates to a resistance exercise device, and more particularly, to a dynamic resistance device which enables amputees to perform exercises.

2. Description of the Related Art

Resistance exercise devices are well known in the art. One example of such an exercise device is described in U.S. Pat. No. 5,207,626 to Einhorn. This device is particularly adapted to exercise scapula related muscles and includes a harness configured to fit over the shoulder and upper arm of one's body. A plurality of tensioning straps and connected urging springs are associated with the harness to provide resistance to upward, forward, and rearward motion during exercising.

Another exercising system is described in U.S. Pat. No. 4,372,553 to Hatfield and is particularly adapted to exercise the abdominal muscle group. The system includes a shoulder harness that is strapped to the upper shoulder portions of the user and secured to weights which are supported on a pulley assembly to provide progressive force resistance during an exercise routine.

Both of the prior art patents discussed hereinabove, describe exercise devices that are used to perform specific exercises directed toward specific muscle groups, and are thus limited in application. Furthermore, these prior art exercise devices are not suited for use by an amputee. It would be beneficial therefore, to provide a resistance exercise system that can be utilized by an amputee to exercise a variety of muscle groups.

SUMMARY OF THE INVENTION

The subject invention is directed to a resistance exercise device for an amputee which includes a harness assembly configured to engage the stump portion of an amputated limb. The harness assembly has a circumferential support strap and a depending retention portion defining a basket-like structure. Resistant means are provided for affording dynamic resistance to the amputee during the performance of an exercise, and engagement means are associated with the circumferential support strap for engaging the resistance means.

Preferably, the retention portion of the harness assembly includes two depending retention straps each having opposed ends connected to the circumferential support strap, and means for selectively varying the respective operative lengths thereof. Means are also provided for selectively varying the diameter of the circumferential support strap. The harness assembly also includes an elongate bracing strap having opposed ends secured to the circumferential support strap at diametrically opposed locations to define a loop positionable about a portion of the amputees body.

In one embodiment of the subject invention, the resistance means comprises an elongated elastomeric member having a first end releasably secured to the engagement means of the support strap and a second end releasably secured to a fixed support structure. Preferably, the resistance means comprises a plurality of interchangeable elongated elastomeric members each having a different predetermined cross-sectional configuration corresponding to a particular tensile strength, each for affording a particular predetermined value of dynamic resistance.

In another embodiment of the subject invention, the resistance means comprises a free-weight assemblage including a cable having a first end releasably secured to the engagement means of the support strap and a second end releasably secured to a selectively variable weighted mass. Preferably, translation of the cable is guided by at least one pulley member mounted to a fixed support structure.

These and other features of the resistance exercise device of the subject invention will become more readily apparent from the following detailed description of the invention taken in conjunction with the drawings.

BRIEF DESCRIPTION OF THE DRAWINGS

So that one skilled in the art to which the subject invention appertains will better understand how to make and use the resistance exercise device of the subject invention, preferred embodiments thereof will be described hereinbelow with reference to the drawings wherein.

DETAILED DESCRIPTION OF THE PREFERRED EMBODIMENTS

Figure 1:
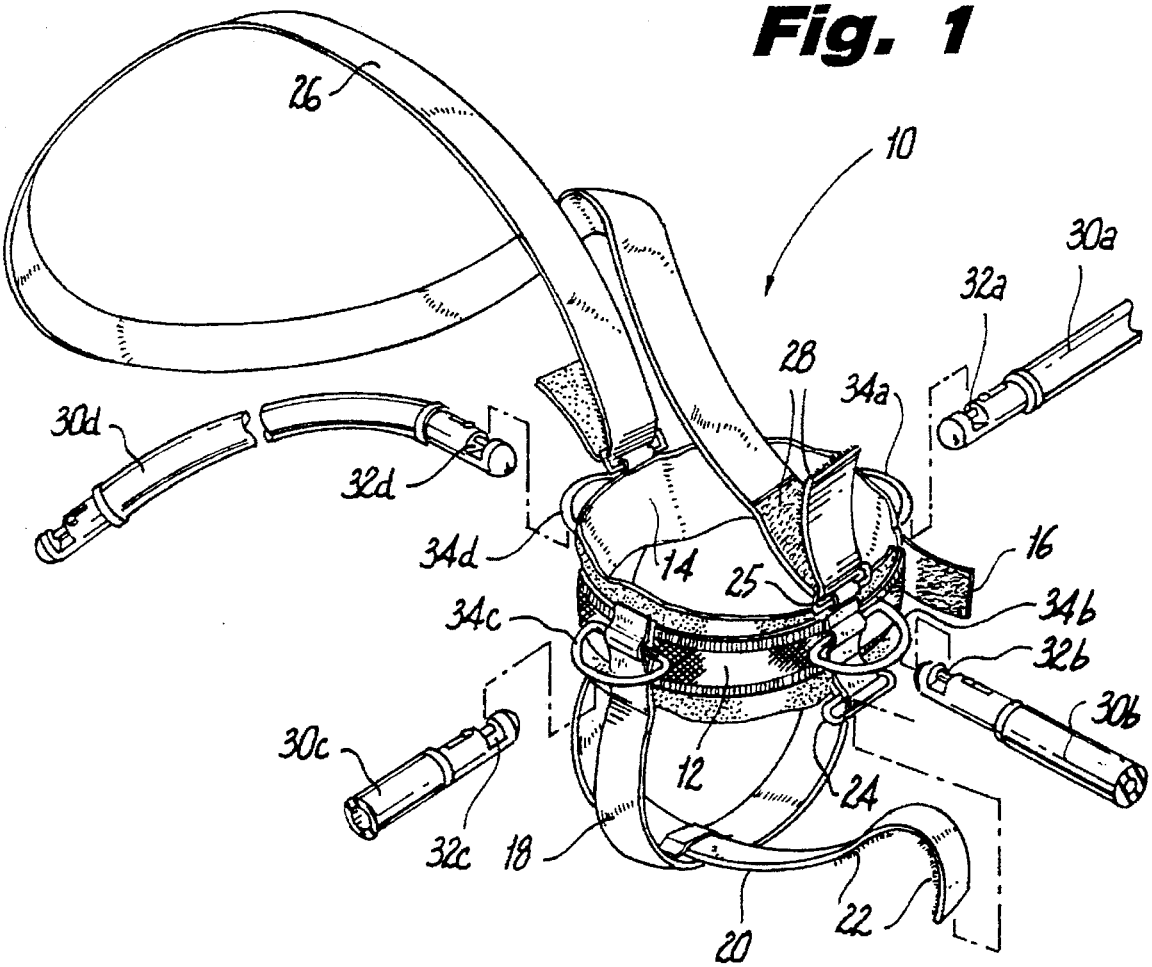
FIG. 1 is a perspective view of a harness assembly constructed in accordance with a preferred embodiment of the exercise device of the subject invention.
Figure 2:
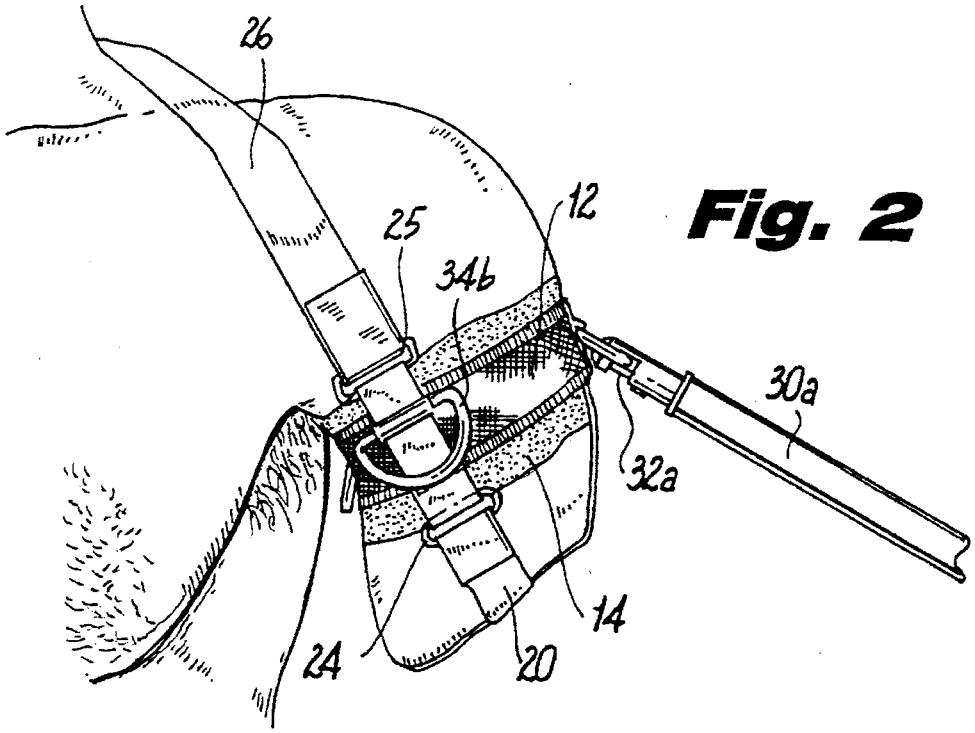
FIG. 2 is a perspective view of the harness assembly illustrated in FIG. 1 in a deployed condition on the stump portion of an amputated arm.
Figure 3:
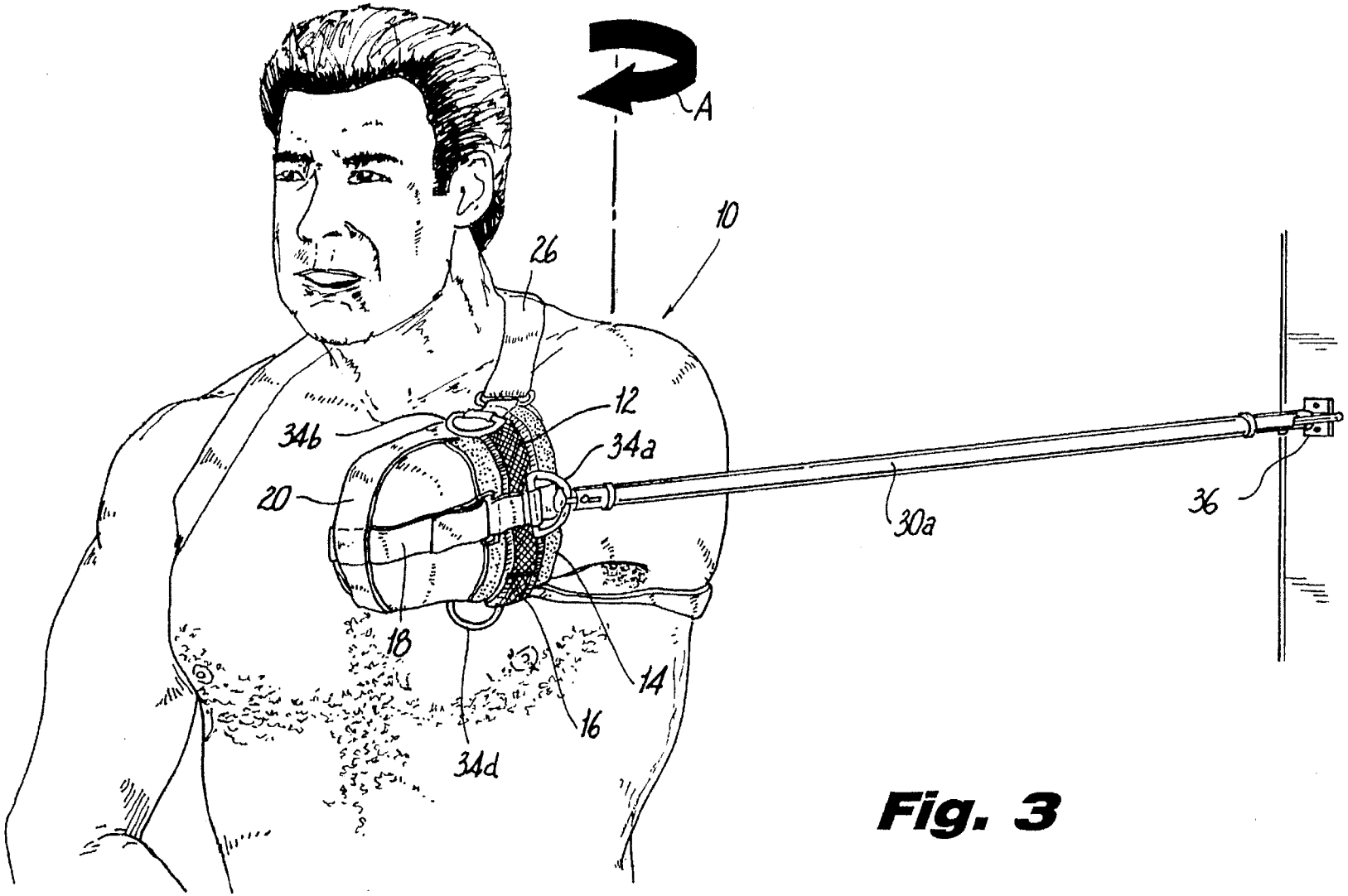
FIG. 3 is a perspective view of the exercise device of the subject invention during the performance of an exercise utilizing an elastomeric tube to afford dynamic resistance to the amputee.
Figure 4:
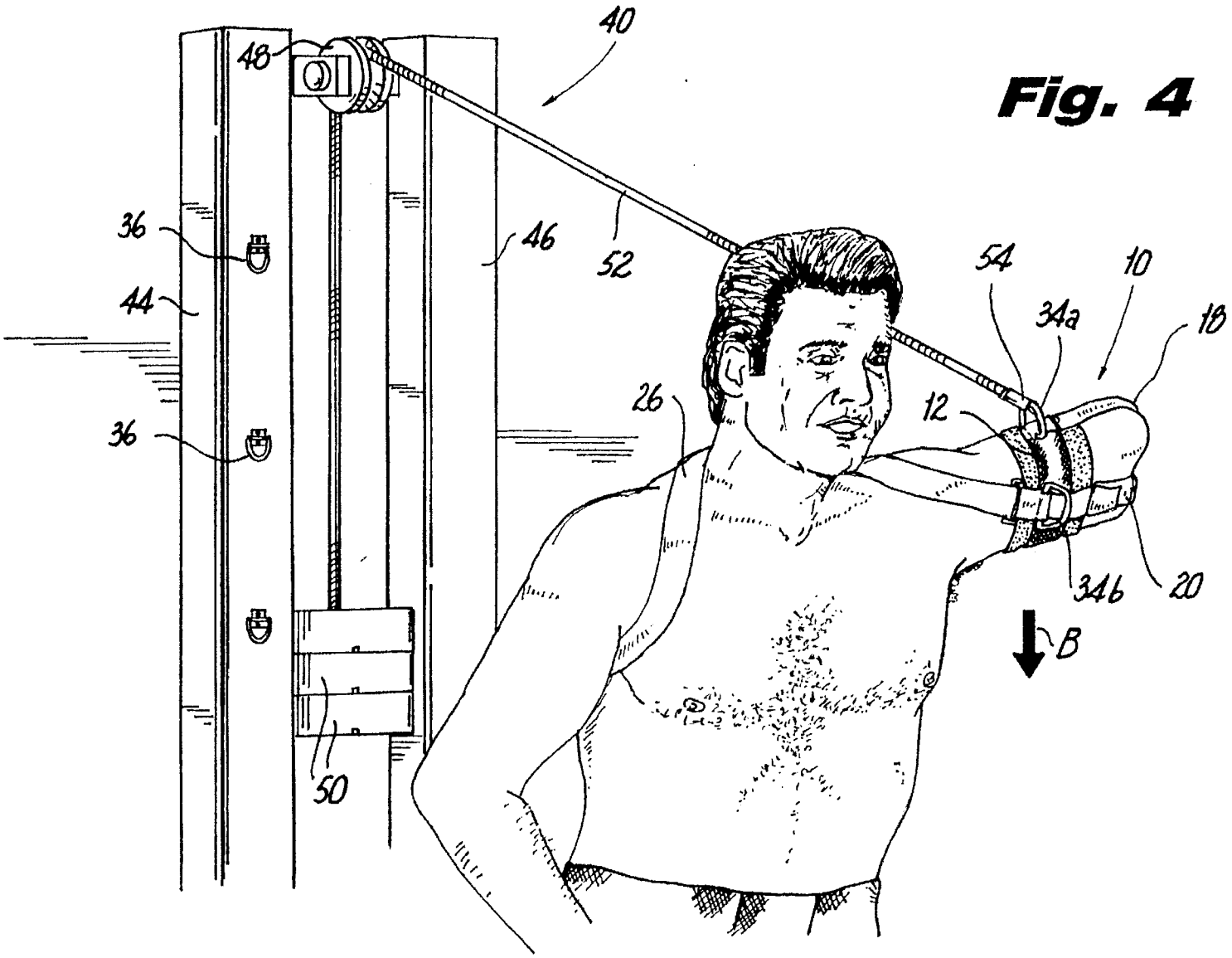
FIG. 4 is a perspective view of the exercise device of the subject invention during the performance of an exercise utilizing a weight and pulley system to afford dynamic resistance to the amputee.

Referring now to the drawings wherein like reference numerals identify similar structural elements of the subject invention, there is illustrated in FIG. 1 a harness assembly constructed in accordance with a preferred embodiment of the subject invention and designated generally by reference numeral 10. As illustrated in FIG. 2, harness assembly 10 is uniquely constructed to engage the stump portion of an amputated limb to enable the performance of a variety of muscle toning exercises. In use, harness assembly 10 is employed with a system for affording dynamic resistance during an exercise. The dynamic resistance can be supplied by an elongated elastomeric tensioning member 30 as shown in FIG. 3, or by a free-weight assembly 40, as shown in FIG. 4.

Referring to FIG. 1, harness assembly 10 includes a circumferential support strap 12 preferably formed of a flexible high-strength woven fabric, such as, for example, nylon. A circumferential layer of padded material 14 is disposed about the inner periphery of support strap 12 to provide comfort for the amputee during an exercise routine. The operative diameter of support strap 12 can be selectively varied by adjusting a hook and loop type fastening assembly 16 of the type marketed under the trademark VELCRO by Velcro Corporation of Manchester, N.H. Other fastening means may be utilized including, for example, buttons, snaps, or hooks.

Retention straps 18 and 20 depend from support strap 12 and are cross-linked with one another to define a basket-like structure configured to engage the stump portion of an amputated limb. The operative length of each retention strap can be selectively varied by adjusting the position of a hook and loop type fastening assembly 22 with respect to an associated adjustment buckle 24. It is envisioned that the retention portion of the harness assembly could be formed by a one-piece retention structure that would enclose the entire stump portion of an amputated limb.

An elongated bracing strap 26 is also associated with support strap 12 and is configured to be positioned about the body of the amputee, to anchor harness assembly 10 during an exercise routine. As illustrated in FIG. 2, the bracing strap is preferably secured under the armpit of the opposing limb. The operational length of bracing strap 26 can be selectively varied by adjusting the position of hook and loop type fastening assembly 28 with respect to adjustment buckle 25. Other means of adjustment are also envisioned.

Referring to FIGS. 1 and 3, harness assembly 10 is configured for use with elastomeric tensioning members 30*a*–30*d*, which afford dynamic resistance during an exercise. As illustrated in FIG. 1, each of the tensioning members has a different wall thickness, and thus each has a distinct tensile strength, and each provides a corresponding predetermined dynamic resistance value. Releasable clasps 32*a*–32*d* are provided on tensioning member 30*a*–30*d*, respectively, to cooperatively engage the securement rings 34*a*–34*d*, which are disposed about the circumference of support strap 12. Each securement ring is positioned in such a location so as to enable the performance of a particular form of exercise, and thus the toning of a distinct muscle group.

In use, as shown in FIG. 3, to perform a particular exercise, i.e. butterfly-type exercises, the amputee selects a desired tensioning member, such as member 30*a*, and secures the release clasp 32*a* thereof to a particular securement ring on support strap 12, such as, for example, securement ring 34*a*. The opposed end of selected tensioning member 30*a*, which is also provide with a release clasp, is then secured to a stationary securement hook 36 which is mounted on a fixed support structure. During the exercise, movement in a direction indicated by arrow "A" (horizontal flexion), against the tension of elastomeric member 30*a*, will effect the upper pectoralis major, anterior deltoid and subscapularis muscle groups located in the chest area of the amputee. In addition, such an exercise, when performed at the shoulder, indirectly trains the shoulder girdle muscle complex which protracts and contracts as related muscle groups are directly trained. Different exercises can be performed by securing the tensioning member to other rings on support strap 12, or by varying the location of the fixed end of the tensioning member (see, for example, the set of spaced apart stationary securement hooks 36*a*–36*d* illustrated in FIG. 4).

Referring to FIG. 4, harness assembly 10 is also configured for use with a free-weight assembly 40. Free weight assembly 40 includes a support structure 42 having two parallel upstanding support beams 44 and 46, a pulley 48 mounted between support beams 44 and 46, a plurality of weight members 50, and an elongated cable 52 which operatively connects the weight members to harness assembly 10. A releasable clasp 54 is provided at the free end of cable 52 for selectively engaging one of the securement rings 34*a*–34*d* on support strap 12.

Referring to FIG. 4, in use, reciprocating movement of the harnessed limb will effect corresponding movement of cable 52 with respect to pulley 48, rasing and lowering weight members 50, thereby providing dynamic resistance to the amputee. The number of weight members can be modified to vary the degree of dynamic resistance afforded by free-weight assembly 40. As illustrated in FIG. 4, when release clasp 54 is engaged to securement ring 34*a*, movement of the harnessed limb in a downward lateral direction, as indicated by arrow "B" (adduction), will effect toning of the latissimus dorsi, teres major and lower pectoralis major. Other exercises can be performed by engaging release clasp 54 to the other securement rings on support strap 12.

Although the subject invention has been described with respect to preferred embodiments, it will be readily apparent to those having ordinary skill in the art to which it appertains that changes and modifications may be made thereto without departing from the spirit or scope of the subject invention as defined by the appended claims. For example, it is envisioned that the harness assembly of the subject invention can also be utilized in conjunction with an amputated leg, to exercise the muscle groups of the lower body. It is also envisioned that dynamic resistance can be supplied by a plurality of coiled springs each having a predetermined spring constant, each for affording a particular value of dynamic resistance.

What is claimed is:

1. An exercise device for an amputee comprising:

a) a harness assembly configured to engage the stump of an amputated limb and including a circumferential support strap and a depending retention portion defining a basket-like structure;

b) resistance means for affording dynamic resistance to the amputee during the performance of an exercise;

c) engagement means associated with said circumferential support strap for engaging said resistance means;

d) an elongate bracing strap having opposed ends secured to said circumferential support strap at diametrically opposed locations to define a loop which can extend around the back of an amputee and over a shoulder of the amputee and;

e) means for adjusting the length of said bracing strap.

2. An exercise device as recited in claim 1, wherein said retention portion of said harness assembly includes at least two depending retention straps each having opposed ends connected to said circumferential support strap.

3. An exercise device as recited in claim 1, further comprising means for selectively varying the diameter of said circumferential support strap.

4. An exercise device as recited in claim 2, further comprising means associated with each of said retention straps for selectively varying the respective operative lengths thereof.

5. An exercise device as recited in claim 2, wherein said engagement means comprises a plurality of releasable fasteners disposed about an outer periphery of said circumferential support strap at equally spaced apart locations and about said retention straps.

6. An exercise device as recited in claim 1, wherein said resistance means comprises an elastomeric tubular member having a first end releasably secured to said engagement means and a second end releasably secured to a fixed support structure.

7. An exercise device as recited in claim 1, wherein said resistance means comprises a cable having a first end releasably secured to said engagement means and a second end releasably secured to a free weight.

8. An exercise device as recited in claim 6, wherein said cable is guided during translation by at least one pulley member mounted to a fixed support structure.

9. An exercise device for an amputee comprising:

a) a harness assembly configured to engage the stump of an amputated limb and including a circumferential support strap and at least two depending retention straps each having opposed ends connected to said circumferential support strap to define a basket-like structure;

b) elastomeric means for affording dynamic resistance to the amputee during the performance of an exercise;

c) engagement means associated with said circumferential support strap for engaging said elastomeric means;

d) an elongate bracing strap having opposed ends secured to said circumferential support strap at diametrically opposed locations to define a loop which can extend around the back of the amputee and over a shoulder of the amputee and;

e) means for adjusting the length of said bracing strap.

10. An exercise device as recited in claim 9, further comprising means for selectively varying the diameter of said circumferential support strap.

11. An exercise device as recited in claim 9, further comprising means associated with each of said retention straps for selectively varying the respective operative lengths thereof.

12. An exercise device as recited in claim 9, wherein said engagement means comprises a plurality of releasable fasteners disposed about an outer periphery of said circumferential support strap at equally spaced apart locations and about said retention straps.

13. An exercise device as recited in claim 9, wherein said elastomeric means comprises an elongated elastomeric member having a first end releasably secured to said engagement means and a second end releasably secured to a fixed support structure, said elastomeric member having a predetermined cross-sectional configuration corresponding to a particular tensile strength.

14. An exercise device as recited in claim 9, wherein said elastomeric means comprises a plurality of interchangeable elongated elastomeric members each having a first end configured to be releasably secured to said engagement means and a second end configured to be releasably secured to a fixed support structure, each of said plurality of interchangeable elastomeric members having a different predetermined cross-sectional configuration corresponding to a particular tensile strength, each for affording a particular dynamic resistance.

15. An exercise device for an amputee comprising: a) a harness assembly configured to engage the stump of an amputated limb and including a circumferential support strap and at least two depending retention straps each having opposed ends connected to said circumferential support strap to define a basket-like structure;

b) a selectively variable gravitational mass for affording dynamic resistance to the amputee during the performance of an exercise;

c) engagement means associated with said circumferential support strap for engaging said gravitational mass;

d) an elongate bracing strap having opposed ends secured to said circumferential support strap at diametrically opposed locations to define a loop which can extend around the back of an amputee and over a shoulder of the amputee and;

(e) means for adjusting the length of said bracing strap.

16. An exercise device as recited in claim 15, wherein said selectively variable gravitational mass comprises a plurality of free-weights each configured to be releasably supported at an end of a cable with an opposed end of said cable comprising a clasp releasably secured to said engagement means comprising a series of rings disposed about an outer periphery of said circumferential support strap at equally spaced apart locations and about said retention straps.

17. An exercise device as recited in claim 16, further comprising at least one pulley mounted on a fixed support structure for guiding said cable during translation.

18. An exercise device as recited in claim 2, comprising a hook and loop type fastening assembly arranged with respect to an associated adjustment buckle about each said retention strap for selectively varying operative length of each said retention strap, and said adjusting means comprising two respective hook and loop type fastening assemblies arranged with respect to associated adjustment buckles on said elongate bracing strap for selectively varying operative length of said elongate bracing strap, and with said adjustment buckles being mounted upon said circumferential support strap at said diametrically opposed locations.

19. An exercise device as recited in claim 9, comprising a hook and loop type fastening assembly arranged with respect to an associated adjustment buckle about each said retention strap for selectively varying operative length of each said retention strap, and said adjusting means comprising two respective hook and loop type fastening assemblies arranged with respect to associated adjustment buckles on said elongate bracing strap for selectively varying operative length of said elongate bracing strap and with said adjustment buckles being mounted upon said circumferential support strap at said diametrically opposed locations.

20. An exercise device as recited in claim 15, comprising a hook and loop type fastening assembly arranged with respect to an associated adjustment buckle about each said retention strap for selectively varying operative length of each said retention strap, and said adjusting means comprising two hook and loop type fastening assemblies arranged with respect to associated adjustment buckles on said elongate bracing strap for selectively varying operative length of said elongate bracing strap and with said adjustment buckles being mounted upon said circumferential support strap at said diametrically opposed locations.

* * * * *